United States Patent [19]

Cunningham et al.

[11] Patent Number: 4,929,976

[45] Date of Patent: May 29, 1990

[54] FILM TRANSPORT SYSTEM

[75] Inventors: John A. Cunningham, Garland; Mark O. Prestjohn, Coppell; Bobby P. Reed, Seagoville; Martin D. Smith, Lewisville, all of Tex.

[73] Assignee: Jamieson Film Company, Dallas, Tex.

[21] Appl. No.: 323,838

[22] Filed: Mar. 15, 1989

[51] Int. Cl.[5] ..... G03D 3/13

[52] U.S. Cl. ..... 354/322; 354/321; 226/92; 226/170; 226/189

[58] Field of Search ..... 354/320, 321, 322; 226/92, 170, 171, 172, 189; 352/235

[56] References Cited

U.S. PATENT DOCUMENTS

| | | | |
|---|---|---|---|
| 1,986,107 | 1/1935 | Heisler | 354/321 |
| 1,991,137 | 2/1935 | Case et al. | 226/92 X |
| 2,810,332 | 10/1957 | Dignan | 354/320 |
| 3,127,079 | 3/1964 | Allander | 226/92 |
| 3,712,206 | 1/1973 | Schmidt | 354/322 |
| 3,810,568 | 5/1974 | Kwiaikowski | 226/92 |
| 3,989,176 | 11/1976 | Hope et al. | 226/189 |
| 4,068,250 | 1/1978 | Anderson et al. | 354/321 |
| 4,131,356 | 12/1978 | Schmidt | 354/322 |
| 4,140,383 | 2/1979 | Schmidt | 354/316 |
| 4,295,728 | 10/1981 | Nishimoto | 354/321 |
| 4,316,664 | 2/1982 | Nishimoto | 354/321 |
| 4,330,191 | 5/1982 | Rawlings et al. | 226/92 X |
| 4,416,529 | 11/1983 | Kastl | 226/189 X |
| 4,613,221 | 9/1986 | Takase et al. | 354/321 |
| 4,613,222 | 9/1986 | Takase et al. | 354/321 |
| 4,641,939 | 2/1987 | Kitner | 354/321 |
| 4,662,554 | 5/1987 | Yamazaki et al. | 226/92 |
| 4,666,279 | 5/1987 | Fujita | 354/320 |
| 4,736,228 | 4/1988 | Ito | 355/75 |
| 4,739,357 | 4/1988 | Zielinski | 354/321 |
| 4,772,907 | 9/1988 | Marson | 354/319 |

*Primary Examiner*—A. A. Mathews

*Attorney, Agent, or Firm*—Daniel V. Thompson

[57] ABSTRACT

A film processing apparatus includes a housing and a pair of continuous belts disposed within the housing in a laterally spaced relationship. Guide rollers within the housing guide the belts about parallel serpentine paths through the housing. Drive rollers engaged with the belts drive the belts in synchronization about the paths through the housing. A film carrier card having attachment elements for selectably engaging the belts is provided, such that the film carrier card is transported through the housing by the belts.

11 Claims, 4 Drawing Sheets

FILM TRANSPORT SYSTEM

TECHNICAL FIELD

This invention relates to photographic film processing apparatus, and more particularly to a system for transporting film through the apparatus.

BACKGROUND ART

Photographic film processing is accomplished by immersing undeveloped film in a number of liquid solutions in a pre-determined order. These steps include developing, bleaching, fixing, rinsing, etc., and it has long been conventional to automate film processing by providing a series of adjacent open-topped tanks in a housing through which long strips of film are sequentially transported by a film transport system.

A number of systems have been devised for transporting film through such a series of tanks. For example, U.S. Pat. No. 4,739,357 to Zielinski and U.S. Pat. No. 4,613,221 to Takase, et al, disclose film processors where one endless timing belt per tank is provided, each belt including projections for engaging apertures in a thin flexible film carrier card to advance a film strip attached to the card through the processing machine. While the use of a film carrier card as taught by these patents is generally advantageous, the use of multiple timing belts, one per tank, results in an unduly complicated construction, and transferring the card from belt to belt creates problems, particularly as noted in the Zielinski patent. Systems utilizing a single pair of spaced belt-like structures running in serpentine paths through all of the tanks have also been disclosed, as in U.S. Pat. No. 4,140,383 to Schmidt, U.S. Pat. No. 4,662,554 to Yamazaki et al, and U.S. Pat. No. 3,810,568 to Kwiaikowski et al. In these systems, the dual serpentine belting arrangement is an advantageous feature, but complicated attachment schemes requiring highly specialized film carriers are required.

Thus there presently exists a need for a film transport system which accommodates the use of a thin flexible film carrier card with a simplified dual serpentine belt arrangement.

SUMMARY OF THE INVENTION

The present invention provides a film transport system wherein a thin flexible film carrier card is transported by way of a pair of continuous serpentine belts through a film processing apparatus housing. In the preferred embodiment, the belts include two longitudinal laterally-spaced rows of apertures, with the outer rows of apertures being engaged with a drive mechanism and the inner rows of apertures being engaged with upstanding attachment elements projecting from a surface of the film carrier card. The attachment elements on the card preferably include substantially conical larger diameter head portions sized to stretch and resiliently engage individual apertures on the belts. Preferred apparatus at load and exit stations is disclosed, along with a technique for removably supporting tank rollers.

BRIEF DESCRIPTION OF THE DRAWINGS

A more complete understanding of the invention and its advantages will be apparent from the Detailed Description taken in conjunction with the accompanying Drawings in which.

DETAILED DESCRIPTION OF THE PREFERRED EMBODIMENT

Figure 1:
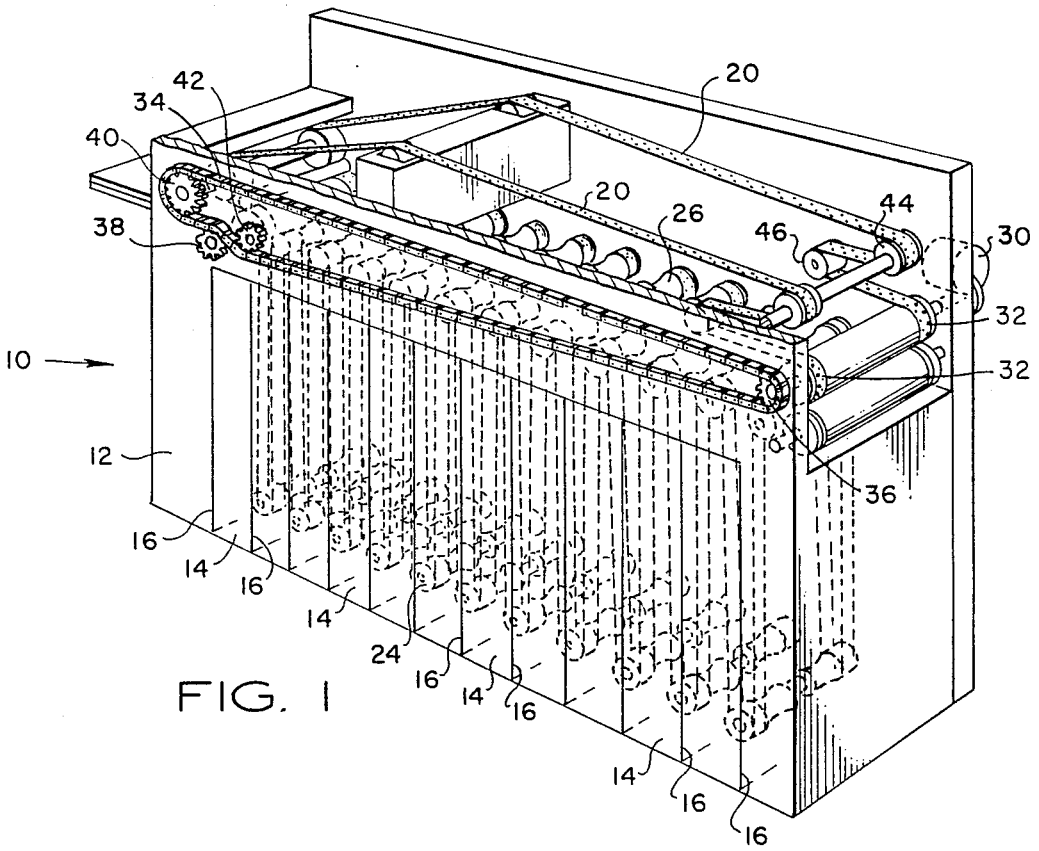
FIG. 1 is a perspective view of film processing apparatus constructed in accordance with the invention.

Referring initially to FIG. 1, film processing apparatus 10 includes a housing 12 and a plurality of adjoining open-topped tanks 14. Tanks 14 are partitioned from each other by vertical walls 16. Each tank 14 includes a processing fluid, such as developing solution, bleaching solution, fixing solution, etc., in conventional fashion.

The film transport system for the apparatus 10 includes a pair of resilient belts 20 disposed within housing 12 in a laterally spaced relationship. Belts 20 are guided through the housing about parallel serpentine paths as defined by a series of tank rollers. The tank rollers include lower tank rollers 24 near the bottom of each tank 14 and upper tank rollers 26 above each vertical wall 16.

A drive mechanism for the belts 20 includes an electric motor and transmission assembly 30 connected to drive sprockets 32. Drive sprockets 32 include lugs for engaging apertures in the belts, as will be described in more detail below. A timing chain 34 extends from a driving chain wheel 36 to driven chain wheel 38 by way of idler wheels 40 and 42. Driving and driven chain wheels 36 and 38, respectively, have the same number of teeth so that their rotational speeds are synchronized. A belt tensioning system includes tensioner rollers 44 and 46, with tensioner roller 44 being spring-biased to maintain a desired level of belt tension.

Figure 2:
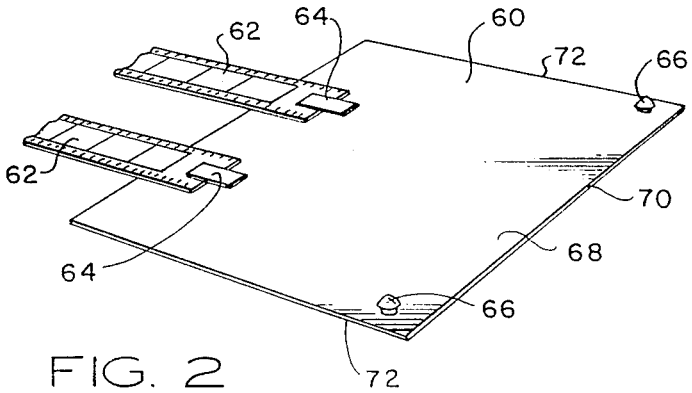
FIG. 2 is a perspective view of a film carrier card for use in the apparatus of FIG. 1.

Referring now to FIG. 2, the film carrier card 60 is a planar, rectangular-shaped member. Preferably, card 60 is approximately five inches square and is formed from a polyester material which is five thousandths of an inch thick. The preferred film carrier is thus very thin and flexible. Film strips 62 are taped by way of tape 64 to a rearward section of film carrier card 60. Attachment elements 66 project upwardly from top surface 68 of card 60. Each of the attachment elements is located at a front corner of card 60 proximate the intersection of front edge 70 and a lateral edge 72.

Figure 3:
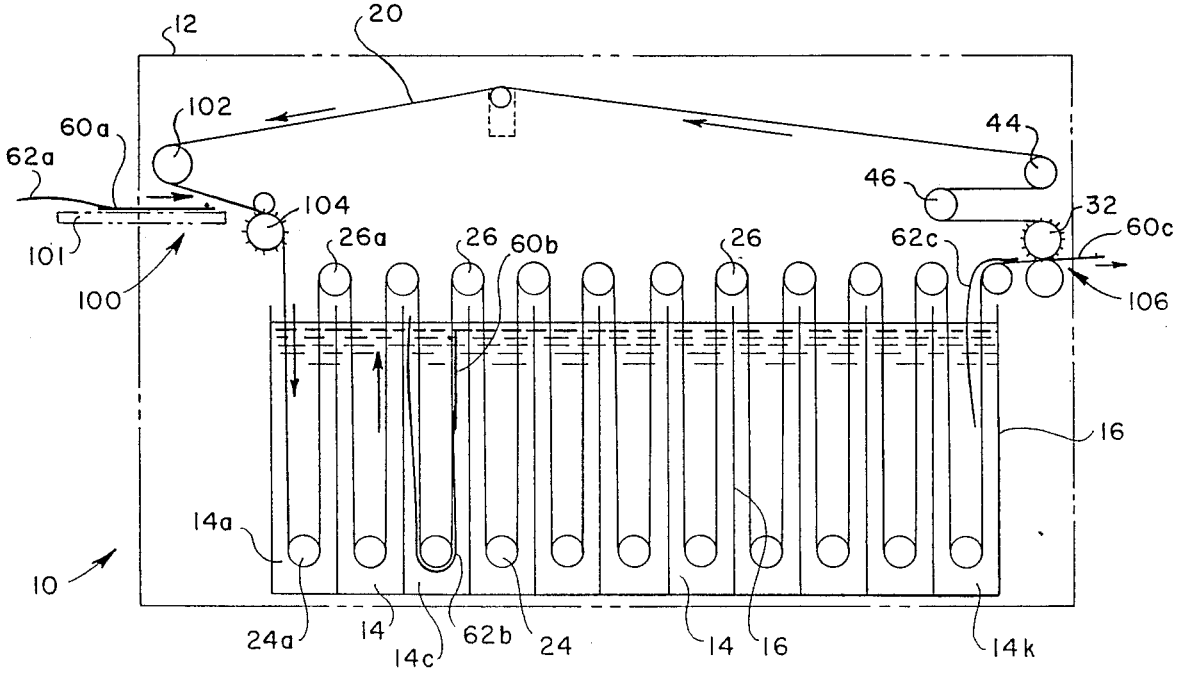
FIG. 3 is a schematic view illustrating the operation of the apparatus and card of FIGS. 1 and 2.

Referring now to FIG. 3, film processing apparatus 10 is adapted to sequentially immerse film strips in the tanks 14 of processing fluids. An essential element of the apparatus is the film transport system including belts 20 and the film carrier cards 60*a*, 60*b* and 60*c*. Each of the film carrier cards shown in FIG. 3 includes at least one film strip 62 taped as shown in FIG. 2 to extend rearwardly from the top surface 68 of the card. Drive sprockets 32 drive the belts 20 in the directions illustrated by the arrows, with tension being maintained by tensioner rollers 44 and 46. Card 60*a* and film strips 62*a* are shown at load station 100 resting upon a loading guide 101 ready to be loaded onto belts 20. Load station 100 includes first loading guide rollers 102 and second loading guide rollers 104. Second loading guide rollers 104 are lugged, with synchronization of the load station 100 being maintained by the timing chain 34 connected to second loading guide rollers 104.

From the load station 100, the belts 20 travel downwardly into a first tank 14*a*, around a pair of first lower tank rollers 24*a* and up over a pair of first upper tank rollers 26*a*. The belts then traverse down and up through each of the adjoining tanks 14 in like fashion, as illustrated by the card 60*b* and attached film strips 62*b* shown immersed and traveling upwardly in tank 14*c*. After the cards and attached film strips traverse through the last tank 14*k*, the cards and film are transported to exit station 106, where card 60*c* and attached film strips 62*c* are being ejected from the housing 12.

Figure 4:
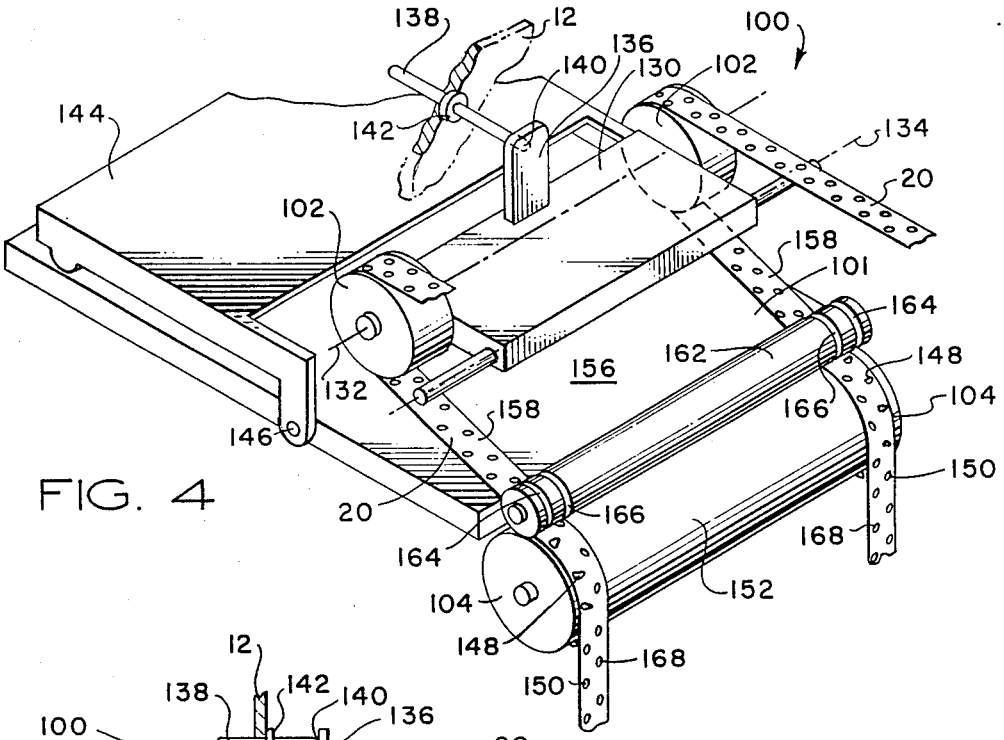
FIG. 4 is a perspective view of the load station of the apparatus.

Referring now to FIG. 4, load station 100 includes a first loading guide roller 102 for each of the belts 20. First loading guide rollers 102 are rotatably mounted on arm 130 for rotation about roller axis 132. Arm 130 is pivotally mounted to the housing for pivoting movements about pivot axis 134. Roller axis 132 and pivot axis 134 are parallel, spaced apart and perpendicular to the paths traversed by belts 20. Finger 136 extends upwardly from a location on arm 130 spaced radially from pivot axis 134. A plunger 138 is fixed for linear motion with respect to housing 12 and contacts finger 136 at plunger 138's innermost tip 140. Plunger 138 has a rest position established by a stop 142 which abuts against an inner surface of housing 12, as shown in FIG. 4. An actuating lever 144 is pivotally mounted to the sides of loading guide 101 at pivot points 146. Second loading guide rollers 104 include a plurality of lugs 148 engaged with outer rows of apertures 150 on belts 20. A cylinder 152 extends between second loading guide rollers 104 and has a radius equal to the radii of second loading guide rollers 104. Second loading guide rollers 104 and cylinder 152 are spaced more closely to guide surface 156 of guide member 101 than first loading guide rollers 102. Thus, the portions 158 of the paths traversed by belts 20 between the first and second loading guide rollers are acutely angled with respect to guide surface 156 on loading guide 101. A loading pinch roller 162 is rotatably mounted in close proximity to cylinder 152. Loading pinch roller 162 includes outer circumferential grooves 164 and inner circumferential grooves 166. Outer circumferential grooves 164 are aligned with lugs 148 and outer rows of apertures 150 on belts 20. Circumferential grooves 166 are aligned with inner rows of apertures 168 on belts 20. In preferred form, each of the belts 20 has two laterally spaced longitudinal rows of apertures 150 and 168 as shown. The two rows of apertures are staggered, and the belt is formed from a flexible plastic material such as polyimide such that the apertures are flexible and resilient.

Figure 5A:
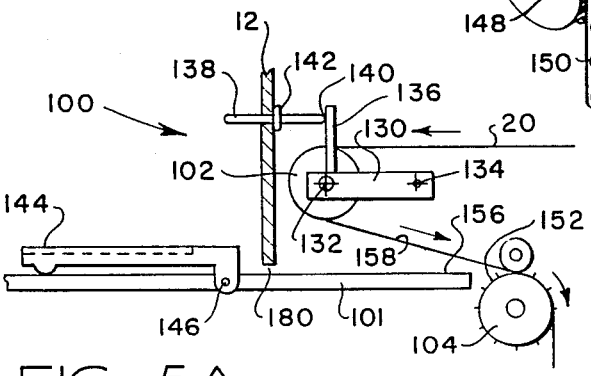
FIGS. 5A–C are schematic views illustrating the operation of the load station of FIG. 4.
Figure 5B:
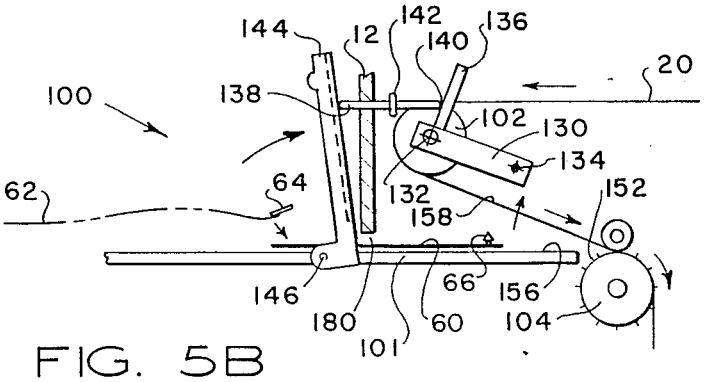
Figure 5C:
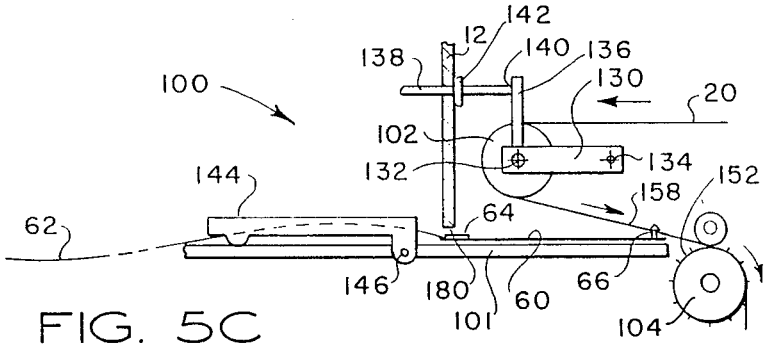

Referring now to FIGS. 5A–5C, arm 130 is illustrated in an engaged position in FIGS. 5A and 5C and a disengaged position in FIG. 5B. In the engaged position, lever 144 is pivoted downwardly adjacent loading guide 101, and plunger 138 is located such that stop 142 is adjacent housing 12. In the disengaged position, as shown in FIG. 5B, lever 144 has been pivoted upwardly to contact and move plunger 138 such that tip 140 causes finger 136 to pivot arm 130 in an upward direction. First loading guide rollers 102 are spaced more closely to guide surface 156 in the engaged position shown in FIGS. 5A and 5C than in the disengaged position shown in FIG. 5B. Likewise, the included angle between guide surface 156 and path portions 158 is smaller in the engaged position shown in FIGS. 5A and 5C than in the disengaged position shown in FIG. 5B.

Thus, loading is accomplished by initially pivoting lever 144 from the position shown in FIG. 5A to the position shown in FIG. 5B, thereby increasing the spaces between first loading guide rollers 102 and guide surface 156. Then, a film carrier card 60 is placed upon guide surface 156, and one or more film strips 62 are attached by way of tape 64 to the trailing end of film carrier card 60. Film carrier card 60 is then slid upon guide surface 156 through a gap between surface 156 and an edge 180 in housing 12 to a load position, as shown in FIG. 5C. The precise location of the load position may be established either by an indexing mark on guide surface 156 or as the limit of sliding movement defined by the location of edge 180 of the housing wall. Attachment elements 66 then become engaged with the moving belts 20 when lever 144 is pivoted to release plunger 138. The spaces between first loading guide rollers 102 and guide surface 156 are decreased thereby bringing the moving belts 20 into contact with the attachment elements 66. The attachment elements 66 flex the belts 20 upwardly until they engage ones of the inner rows of apertures 168. As the card 60 is then pulled between second loading guide rollers 104, cylinder 152 and loading pinch roller 162, the belts 20 and the film carrier card 60 are pinched together while attachment elements 66 pass through inner circumferential grooves 166. The attachment elements 66 are sized to stretch and resiliently engage the inner apertures when belts 20 are pressed together with film carrier card 66 by way of loading guide rollers 104, cylinder 152 and loading pinch roller 162.

Figure 6:
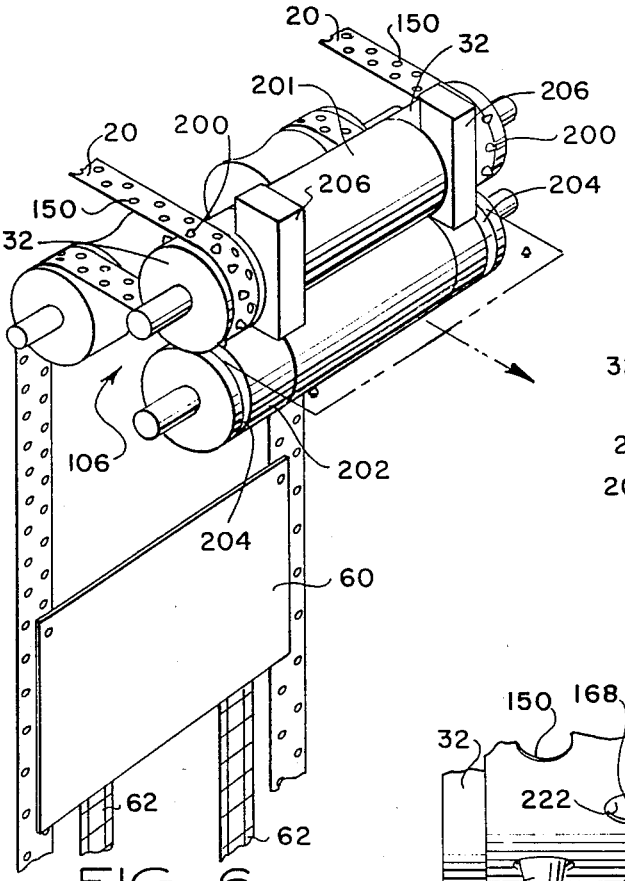
FIG. 6 is a perspective view of an exit station of the apparatus.
Figure 7:
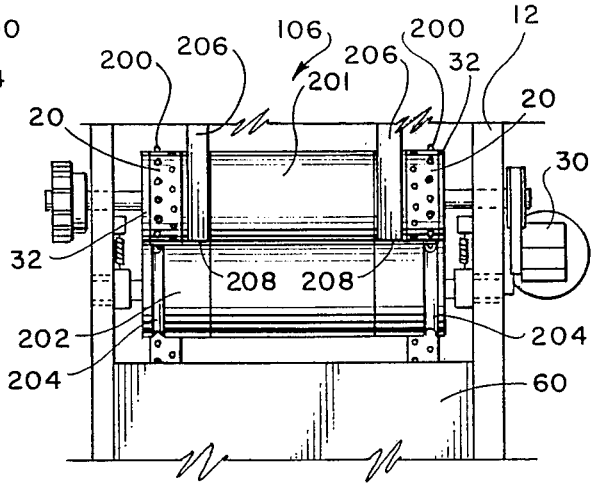
FIG. 7 is an end view of the exit station of FIG. 6.

Exit station 106, as shown in FIGS. 6 and 7, includes drive sprockets 32 having lugs 200 engaged with outer rows of apertures 150. Cylinder 201 is located intermediate drive sprockets 32 and has a radius equal to the radii of drive sprockets 32. A film carrier card 60 with attached film strips 62 is shown attached to belts 20 as previously described. An exit pinch roller 202 is located in close proximity to drive sprockets 32. Exit pinch roller 202 includes circumferential grooves 204 aligned with lugs 200 on drive roller 32. A pair of guide blocks 206 are supported by housing 12 and have exit guide surfaces 208.

Figure 8:
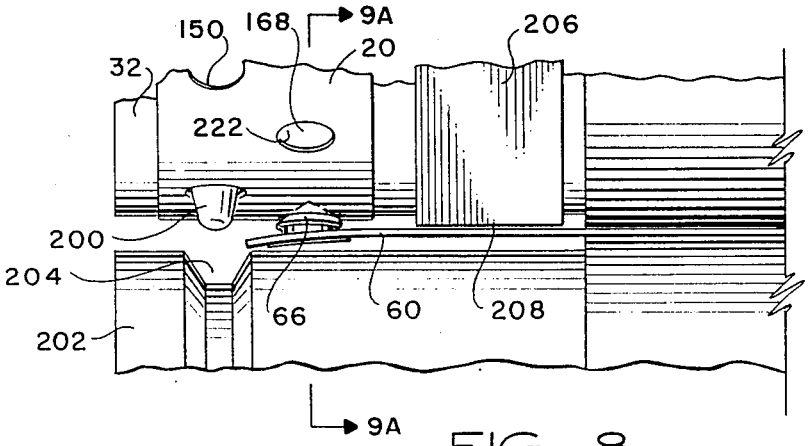
FIG. 8 a partial, enlarged view of the exit station.
Figure 9A:
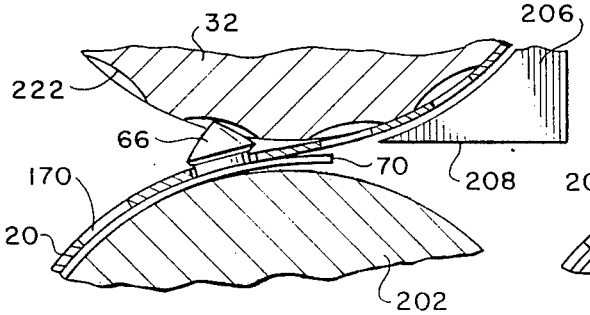
FIG. 9A is a sectional view taken along lines 9A—9A in FIG. 8.
Figure 9B:
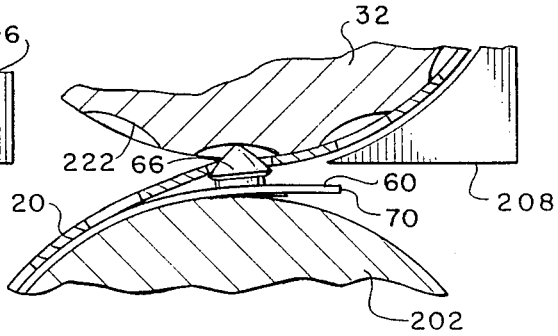
FIG. 9B is a view similar to FIG. 9A showing the film carrier card slightly advanced.

As best shown in FIGS. 8, 9A and 9B, exit station 106 serves to disengage attachment elements 66 from the inner rows of apertures 168 of belts 20, thereby separating film carrier card 60 from the paths traversed by belts 20 and transporting film carrier card 60 through a housing exit opening (not shown) adjacent exit guide surfaces 208. The drive sprockets 32 include circumferential rows of indentations 222 having a pitch equal to that of the inner rows of apertures 168. As shown in FIGS. 9A and 9B, as belts 20 approach drive sprockets 32, ones of the indentations 222 come into contact with the attachment elements 66 and push the attachment elements 66 out of resilient engagement with the inner rows of apertures 168. At the point of disengagement, as shown in FIG. 9B, the front edge 70 of film carrier card 60 is located at a position where exit guide surfaces 208 guide film carrier card 60 in the direction of the exit opening. Once film carrier card 60 has been transported through the exit opening, an operator may retrieve the card and its attached film strips for further handling.

Figure 10:
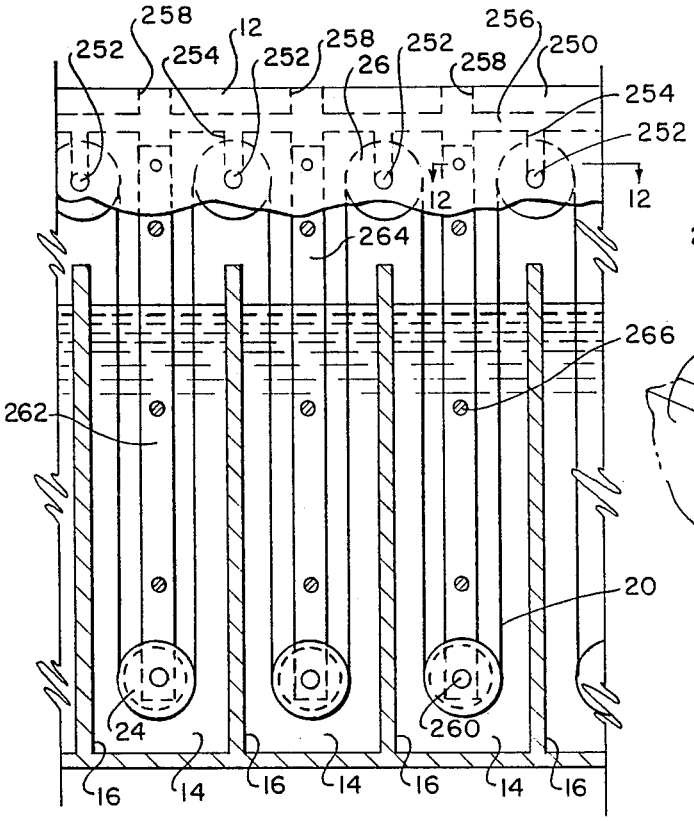
FIG. 10 is a partially broken away side view of the tank rollers and tanks of the apparatus.
Figure 11:
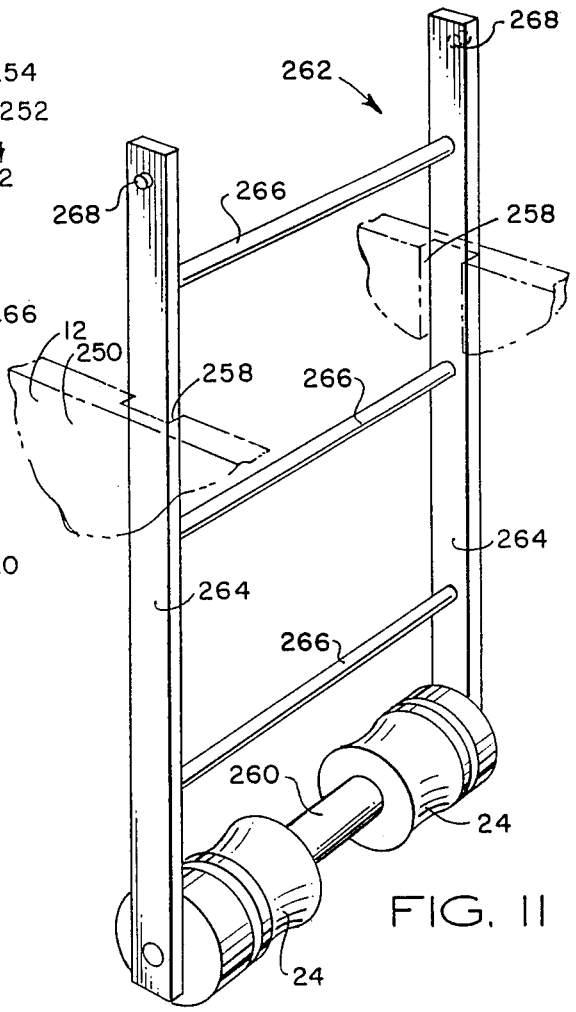
FIG. 11 is a perspective view of a frame for lower tank rollers used in the apparatus.
Figure 12:
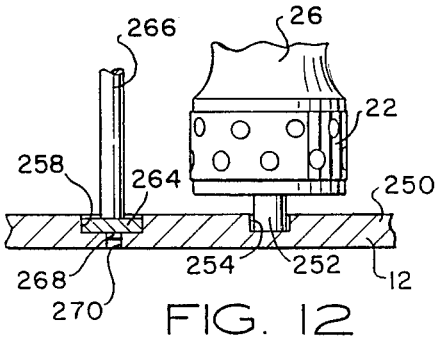
FIG. 12 is a partially broken away top view of a frame and upper tank roller used in the apparatus.

As best shown in FIGS. 10, 11 and 12, the sidewalls 250 of housing 12 include a number of slots for supporting the lower tank rollers 24 and the upper tank rollers 26. Specifically, upper tank rollers 26 are supported on axles 252 in stub slots 254 depending from horizontal slots 256. Vertical slots 258 intersect horizontal slots 256 intermediate the stub slots 254. The lower tank rollers 24 are mounted to axles 260 which are carried by frames 262 each composed of two frame rails 264 and separators 266. Frame rails 264 are sized to slidably engage vertical slots 258. Projections 268 extend outwardly from each of the frame rails 264 at the upper portions thereof. As shown in FIG. 12, holes 270 in sidewalls 250 are provided to register with projections 268 when the frames 262 are located in position.

Assembly and maintenance of the apparatus is made more efficient by the tank roller mounting arrangement shown in FIGS. 10, 11 and 12. Specifically, the upper tank rollers 26 are removable from the housing by sliding axles 252 up stub slots 254 and through horizontal slots 256 to be removed by way of the top portions of vertical slots 258. In use, the tension on belts 20 locates axles 252 at the bottom of stub slots 254. Removal of frames 262, which carry lower tank rollers 24, is accomplished by compressing the upper portions of frame rails 264 together to release projections 268 from holes 270. The entire frame 262 may then be translated upwardly through vertical slots 258 to inspect lower tank rollers 24. Installation of frames 262 with attached lower tank rollers 24 is accomplished by reversing this procedure.

Figure 13A:
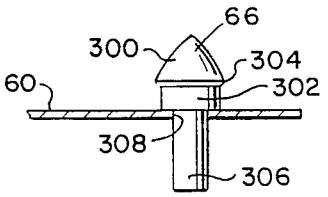
FIGS. 13A and 13B illustrate the formation of an attachment element on a film carrier card.
Figure 13B:
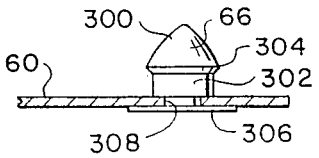

Referring now to FIGS. 13A and 13B, in the preferred embodiment, each attachment element 66 includes a substantially conical head portion 300 attached to a neck portion 302. Head portion 300 has a largest diameter at circular edge 304, where it is connected to neck portion 302 having a smaller diameter than edge 304. The diameter of edge 304 is sized to be slightly larger than the diameter of the inner rows of apertures 168 of belts 20. Thus, head portions 300 stretch and resiliently engage and disengage ones of the inner rows of apertures 168 at load station 100 and exit station 106, as previously described. In the preferred embodiment, attachment elements 66 are connected to film carrier card 60 by way of a thermoplastic shank 306 inserted into a hole 308 in film carrier card 60. Shank 306 is then flattened as shown in FIG. 13b by way of a heated iron, thereby permanently connecting attachment element 66 to film carrier card 60.

Whereas the present invention has been described with respect to a specific embodiment thereof, it will be understood that various changes and modifications will be suggested to one skilled in the art and it is intended to encompass such changes and modifications as fall within the scope of the appended claims.

We claim:

1. Film processing apparatus, comprising:

a housing;

a pair of continuous belts disposed within said housing in a laterally spaced relationship;

guide means within said housing for guiding said belts about parallel paths through said housing;

drive means engaged with said belts for driving said belts in synchronization about said paths;

a film carrier having attachment means for selectably engaging said belts, such that said film carrier is transported through said housing by said belts; and wherein each of said belts has two laterally spaced longitudinal rows of apertures, with apertures of a first one of said rows being engageable with said drive means and apertures of a second one of said rows being engageable with said film carrier.

2. The film processing apparatus of claim 1 wherein the first row of apertures on each belt is located outside the second row of apertures on each belt.

3. The film processing apparatus of claim 1 wherein said film carrier is a planar rectangular card formed from a thin flexible material, and said attachment means includes at least one attachment element projecting from a surface of said card at each of two front corners thereof for selective engagement with said second rows of apertures of said belts.

4. Film processing apparatus, comprising:

a housing;

a pair of continuous resilient belts disposed within said housing in a laterally spaced relationship;

guide means within said housing for guiding said belts about parallel paths through said housing;

drive means engaged with said belts for driving said belts in synchronization about said paths;

a film carrier having attachment means for engaging said belts, such that said film carrier is transported through said housing by said belts;

each of said belts having inner and outer laterally spaced longitudinal rows of apertures, with said outer rows of apertures on each belt being engageable with said drive means and said inner rows of apertures on each belt being engageable with said attachment means; and said film carrier being a planar rectangular card formed from a thin flexible material, and said attachment means including attachment elements projecting from a surface of said card at front corners thereof for engagement with said inner rows of apertures in said belts, said attachment elements being substantially conical in shape and having larger diameter head portions and smaller diameter neck portions sized to stretch and resiliently engage said inner rows of apertures.

5. The film processing apparatus of claim 4 further comprising loading means for engaging said film carrier with said belts, said loading means including at least one guide surface for supporting said film carrier, with said film carrier being slidable on said guide surface for movement to a load position for engagement with said belts.

6. The film processing apparatus of claim 5 wherein:

said guide means includes first and second load station guide rollers;

said first load station guide roller being located opposite and spaced apart from said guide surface;

said second load station guide roller being spaced more closely to said guide surface than said first load station guide roller;

the portion of said paths between said first and second load station guide rollers being acutely angled with respect to said guide surface; and said belts being driven in the direction from said first load station guide roller to said second load station guide roller, such that said film carrier is selectively engageable with said belts by inward sliding movement to said load position on said guide surface.

7. The film processing apparatus of claim 6, wherein: said first load station guide roller is rotatably mounted on an arm for rotation about a roller axis;

said arm is pivotally mounted to said housing for pivoting movements about a pivot axis between engaged and disengaged positions;

said roller and pivot axes being parallel, spaced apart and perpendicular to said paths; and said first load station guide roller being spaced more closely to said guide surface in said engaged position than in said disengaged position, such that said film carrier supported on said guide surface at said load position is engageable with said belts by pivoting said first load station guide roller from said disengaged position to said engaged position.

8. The film processing apparatus of claim 7 further comprising actuation means located exterior said housing for pivoting said first load station guide roller between said engaged and disengaged positions.

9. The film processing apparatus of claim 4 further comprising exit station means for ejecting said film carrier from said housing, said exit station means including means for disengaging said attachment elements from said inner rows of apertures of said belts.

10. The film processing apparatus of claim 9 wherein said exit station means further comprises means for separating said film carrier from said paths.

11. The film processing apparatus of claim 10 wherein said means for separating includes force means for causing relative movement between said attachment elements and said inner rows of apertures to stretch and resiliently disengage said head portions of said attachment elements from said apertures.

* * * * *